US006467234B1

(12) United States Patent
Marshall

(10) Patent No.: US 6,467,234 B1
(45) Date of Patent: Oct. 22, 2002

(54) STAIRWAY SYSTEM

(76) Inventor: Nicholas James Marshall, Gatcombe Mill House, Flax Bourton, Bristol BS48 3QU (GB)

( * ) Notice: Subject to any disclaimer, the term of this patent is extended or adjusted under 35 U.S.C. 154(b) by 0 days.

(21) Appl. No.: 09/445,547

(22) PCT Filed: Jun. 10, 1998

(86) PCT No.: PCT/GB98/01688

§ 371 (c)(1),
(2), (4) Date: Dec. 9, 1999

(87) PCT Pub. No.: WO98/57008

PCT Pub. Date: Dec. 11, 1998

(30) Foreign Application Priority Data

Jun. 10, 1997 (GB) ..... 9711944
May 19, 1998 (GB) ..... 9809619

(51) Int. Cl.[7] ..... E04F 11/09; E04F 11/00; E06C 7/44; E04G 27/00

(52) U.S. Cl. ..... 52/741.2; 52/102; 52/169.4; 52/182; 52/183; 52/188; 182/194; 182/206; 182/230

(58) Field of Search ..... 52/182, 183, 184, 52/188, 190, 191, 169.4, 174, 177, 179, 741.2, 4, 102; 182/45, 194, 107, 109, 206, 228.2, 230

(56) References Cited

U.S. PATENT DOCUMENTS

| | | | | | |
|---|---|---|---|---|---|
| 2,708,543 | A | * | 5/1955 | Matich | 182/196 |
| 3,343,316 | A | * | 9/1967 | McIntire | 52/183 X |
| 3,813,831 | A | * | 6/1974 | Tate | 52/169.4 X |
| 4,362,425 | A | * | 12/1982 | Dixon | 404/16 |
| 4,632,219 | A | * | 12/1986 | Rayer | 182/45 |
| 4,706,425 | A | * | 11/1987 | Brumbalough | 52/182 |
| 4,951,434 | A | * | 8/1990 | Schmidt | 52/191 |
| 5,180,031 | A | * | 1/1993 | Smith | 182/45 X |
| 5,807,021 | A | * | 9/1998 | Aaron | 52/177 X |
| 6,012,254 | A | * | 1/2000 | Gaston | 52/102 |

FOREIGN PATENT DOCUMENTS

| | | | | |
|---|---|---|---|---|
| AT | 180713 | * | 6/1954 | 182/45 |
| DE | 1264030 | * | 3/1968 | 52/182 |
| DE | 2700738 | * | 7/1978 | 52/182 |
| DE | 3014318 | * | 11/1980 | |
| DE | 4131349 | * | 3/1993 | |
| EP | 753645 | * | 1/1997 | |
| FR | 1462370 | * | 12/1966 | 52/179 |
| FR | 2388124 | * | 12/1978 | 182/45 |
| GB | 582113 | * | 11/1946 | 52/182 |
| GB | 1273538 | * | 5/1972 | |
| GB | 2131475 | * | 6/1984 | 182/45 |
| GB | 2217359 | * | 10/1989 | |

* cited by examiner

*Primary Examiner*—Laura A. Callo
(74) *Attorney, Agent, or Firm*—Larson & Taylor, PLC

(57) ABSTRACT

A prefabricated stairway module (10, 11) comprises a first step and a second step, each step (14) having a tread member (13) and a riser member (15). The stairway module further has fixing means (31) for fixing the module to a sloping surface on which it is laid. The steps in a module may be connected to each other by a rigid or flexible bridging member (19), and the tread member (13) may be curved. Different designs and configurations of the prefabricated modules may be combined into a stairway assembly, the modules which can be chosen according to the gradient of the underlying surface on which the stairway is to be constructed.

12 Claims, 6 Drawing Sheets

STAIRWAY SYSTEM

BACKGROUND OF INVENTION

The present invention relates to a stairway, in particular a stairway for use out-of-doors and on rough sloping terrain.

SUMMARY OF THE PRIOR ART

Stairways comprise a series of stairs disposed at intervals along the length of a stairway, which enable a user to travel between two or more levels. The stairway is normally a rigid assembly installed between fixed points on a structure or slope. The construction of the stairway normally entails significant site preparation, time and cost.

In GB 1 273 538, a flight of stairs is described in which a substantially flat metal sheet is bent successively in alternate directions to create a series of steps. A half-landing is provided at the top of a first flight, and a second flight is provided upwardly from that landing. The staircase is intended to be located in the stairwell of a building, and rests at its lower end on the ground floor of the building.

In GB 2 217 359, a staircase is described in which a single-piece concrete casting incorporates pre-stressed wires, which strengthen the staircase and enable load exerted thereon to be transferred to a landing structure.

Both of the above-referenced documents describe staircases suitable for use indoors. However, it is often desired that a stairway for use out-of-doors is able to be constructed on a more temporary basis, preferably such that it can be easily dismantled after use. The structures described above, although suitable for use on a permanent or semi-permanent basis, are less suitable for short-term or temporary use out-of-doors. In particular, if a stairway is required for use on a sloping hillside, for example, or open ground, it is desirable to provide an assembly that is quick and simple to construct, and that requires minimal site preparation. U.S. Pat. No. 3,813,831 describes a knock-down precast staircase, which is suitable for use on sloping hillsides. The staircase comprises individual tread elements and riser elements which are connected together to provide a series of steps. Each step is constructed in turn, and is joined to the next by an interrelationship between the tread element of one step and the riser element of the next. Each riser element includes an intermediate strut, which can support the back edge of the tread element of the next step down.

In EP 0 753 645, a one-piece angled step is described, in which one arm forms a tread element and the other forms a riser element. Hooks or claws are provided on the step for engaging it in the ground. Several such steps may be placed in the ground, one above the other, to provide a stairway-like assembly. Each step may be bonded to the next using a connecting tie.

In the latter two constructions above, only a single step at a time can be secured in the ground, so that the construction of a stairway assembly comprising a series of stairs requires significant site preparation, time and effort.

SUMMARY OF THE INVENTION

The present invention aims to facilitate the provision of a stairway out-of-doors, in particular for use on sloping open ground or rough terrain.

According to a first aspect of the present invention, there is provided use of a prefabricated stairway module to form a stairway resting on a sloping surface, the module comprising a first step and a second step, each step having a tread member and a riser member, the stairway module further including plural fixing means spaced along its ascending length for fixing the module to the sloping surface;

wherein:

the first step and the second step are inseparably joined by a bridging member, the bridging member being inclined relative to the tread and riser members so as to conform to the sloping surface, at least some of the fixing means being associated with the bridging member.

According to a second aspect of the present invention there is provided a prefabricated stairway module for resting on a sloping surface, comprising at least first, second and third steps, each step having a tread member and a riser member, the stairway module further including plural fixing means spaced along its ascending length for fixing the module to the sloping surface;

wherein:

the first step and the second step are inseparably joined by a first bridging member and the second step and third steps are inseparably joined by a second bridging member, the first and second bridging members being inclined relative to the tread and riser members, with the first and second bridging members being on the same plane, at least some of the fixing means being associated with at least one of the bridging members.

Preferably, the fixing means includes plural pins, hooks, claws or tethers. The fixing means may be driven through through-holes in the stairway and into the ground on which the stairway lies. Preferably, pins are provided which are driven perpendicularly through through-holes in the module and into the underlying ground. The stairway modules may be further attached by tethers to other supporting structures, to ensure stability of the structure.

The steps in a prefabricated stairway module are preferably rigidly connected to each other. The module may have integrally formed steps. Alternatively, steps in a single module of stairway may be releasably connected to each other, so that the number of steps in the module may be varied according to the length of the slope against which the stairway is to be laid. The steps in a single module may be bonded together by bolts, pins, ties, rivets, hooks, rings, shackles, or other such connectors known in the art.

The module of stairway may be constructed in such dimensions that the depth of the tread member differs from the height of the riser member of the same stair. In this way, the stairway module may be used reversibly, depending on the gradient of the surface against which the stairway is laid.

The steps in a single prefabricated module may be spaced from each other by a bridging member, which may be substantially L-shaped or V-shaped. The configuration of the bridging member will determine the angle at which successive steps in the stairway lie relative to one another. Hence, variations in the gradient of the surface on which the stairway lays can be accommodated by selecting a stairway module wherein the successive steps lie at a suitable angle relative to each other.

The tread member of each step may be curved, again to enable variations in the gradient of the supporting surface to be accommodated. The tread member may incorporate a non-slip surface, such as a patterned, textured, ribbed or perforated surface or an area of mesh.

The tread member of each step in the stairway module may be mounted on a flexible base structure, so that its orientation relative to the slope on which the module is laid can be varied, depending on the gradient of the slope. The flexible base structure may be of moulded plastic, fiberglass, rubber, mesh, woven fibre, or some other suitable flexible material.

The stairway module may be provided with a handrail or guide-rope at one or each side thereof.

In a third aspect, the present invention provides a stairway including at least one stairway module according to the first aspect. The stairway may be constructed using any number and combination of prefabricated modules according to the first aspect. Thus, the stairway may include only modules incorporating rigid bridging members, or only modules incorporating flexible base structures, or a combination of both types of module. Preferably, the stairway modules constituting a multi-modular stairway are joined together by pins or the like, to stabilise and secure the stairway structure.

Preferably, the stairway modules are reusable, and are easily joinable together to form a quickly assemblable and dismantlable stairway construction.

Accessories may be provided for use in conjunction with stairway modules in a stairway according to the present invention. These may include connector plates for securely connecting individual modules in a multi-modular stairway, handrails, guide-ropes, modules of walkway, and non-slip tread surfaces.

Preferably, the stairway modules are suitable for use in the construction of either a temporary or a permanent stairway.

In a fourth aspect of the present invention, there is provided a kit-of-parts for constructing a stairway on an inclined surface, the kit including at least two prefabricated stairway modules according to the first aspect. Preferably, several modules of stairway are provided in various designs and sizes, and with various multiples of stairs. The modules are securable together by suitable connections or fixings.

BRIEF DESCRIPTION OF THE DRAWINGS

Specific embodiments of the present invention will now be described, by way of example only, with reference to the accompanying drawings in which.

DETAILED DESCRIPTION

Figure 1:
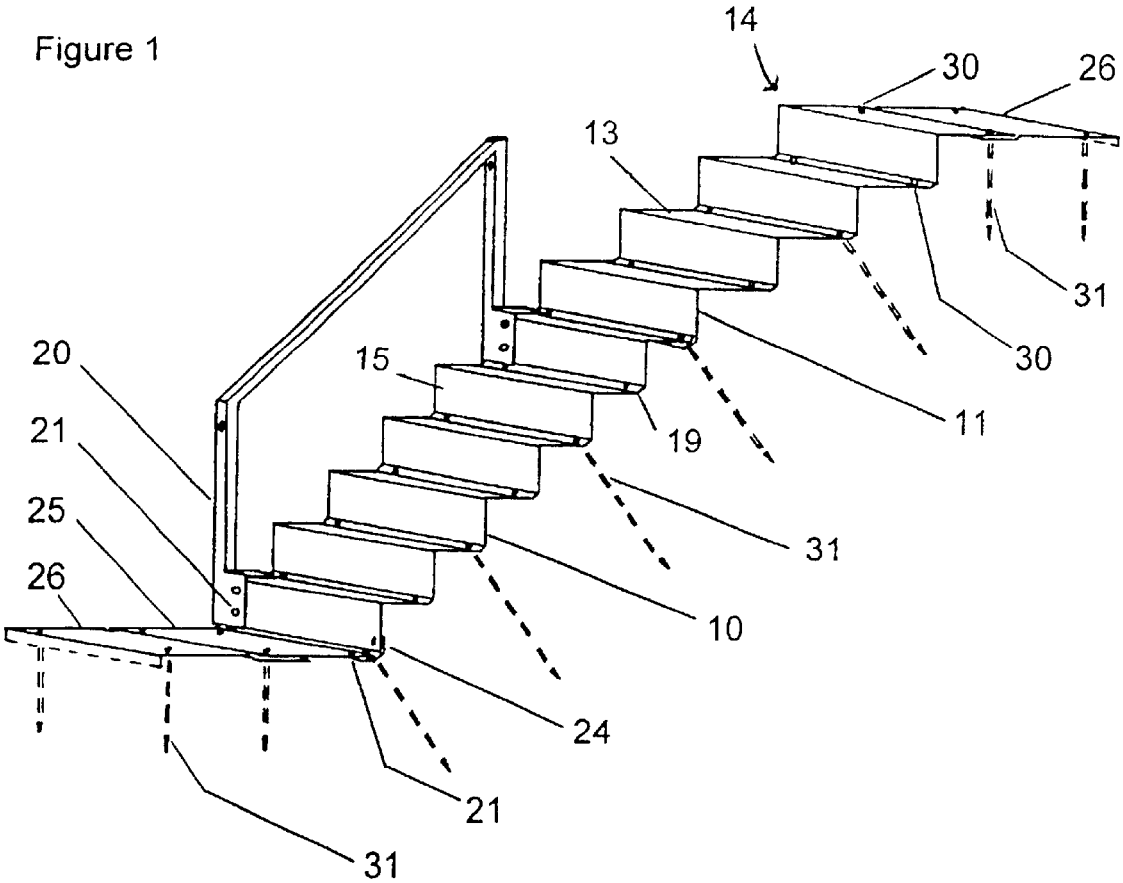
FIG. 1 shows a perspective view of a stairway comprising modules according to a third aspect of the present invention.

Referring to the drawings, the stairway shown in FIG. 1 comprises two rigid modules of stairway 10, 11 selected according to the gradient of the site, which are attached to each other and to the ground using fixings such as pins 31. The fixings are located in housings in the stairway such as holes or slots 30, and are inserted or driven into the ground approximately perpendicularly to the slope of the ground. Accessories such as a handrail 20, a connector plate 24, a module of walkway 25 and a landing plate 26, together with fixings such as nuts and bolts 21, are incorporated into the assembly.

The stairway modules 10, 11 each comprise a sheet of bent metal or other suitable material, the steps in a single prefabricated module being integrally formed from a single sheet. Each step 14 comprises a riser member 15 and a tread member 13 approximately perpendicularly disposed relative to each other. Each step 14 is spaced from the next step by a bridging member 19, the configuration of which will depend on the gradient of the supporting slope for which the stairway module is designed. The bridging member may be, for example, substantially L-shaped or V-shaped.

The fixings 31 which attach the stairway modules 10, 11 to the ground are disposed at regular intervals along the length of the stairway modules, so that the stairway is stably fixed against the surface on which it is laid.

Figure 2:
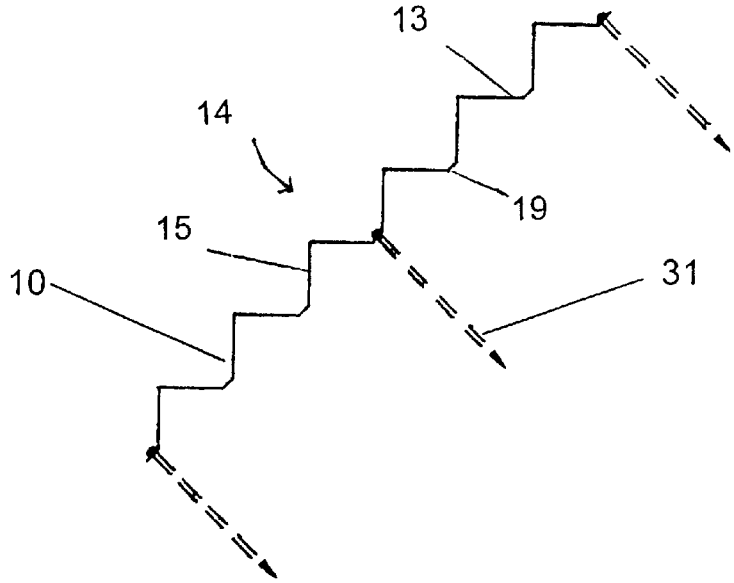
FIG. 2 and FIG. 3 show embodiments of modules according to a third aspect of the present invention.

Referring to FIG. 2, a rigid module of stairway 10 is shown. The riser member 15 and tread member 13 of each step 14 are of approximately the same dimensions, so that each step 14 has an approximately square cross-section. Each step 14 is spaced from the next step by a bridging member 19, which comprises an obliquely slanting section of the sheet material from which the stairway module 10 is formed. The angle of the bridging member 19 relative to the riser member 15 and the tread member 13 will depend on the gradient for which the stairway module 10 designed. The stairway module comprises six steps 14, and is located against the ground by three pins 31 on each side of the module.

Figure 3:
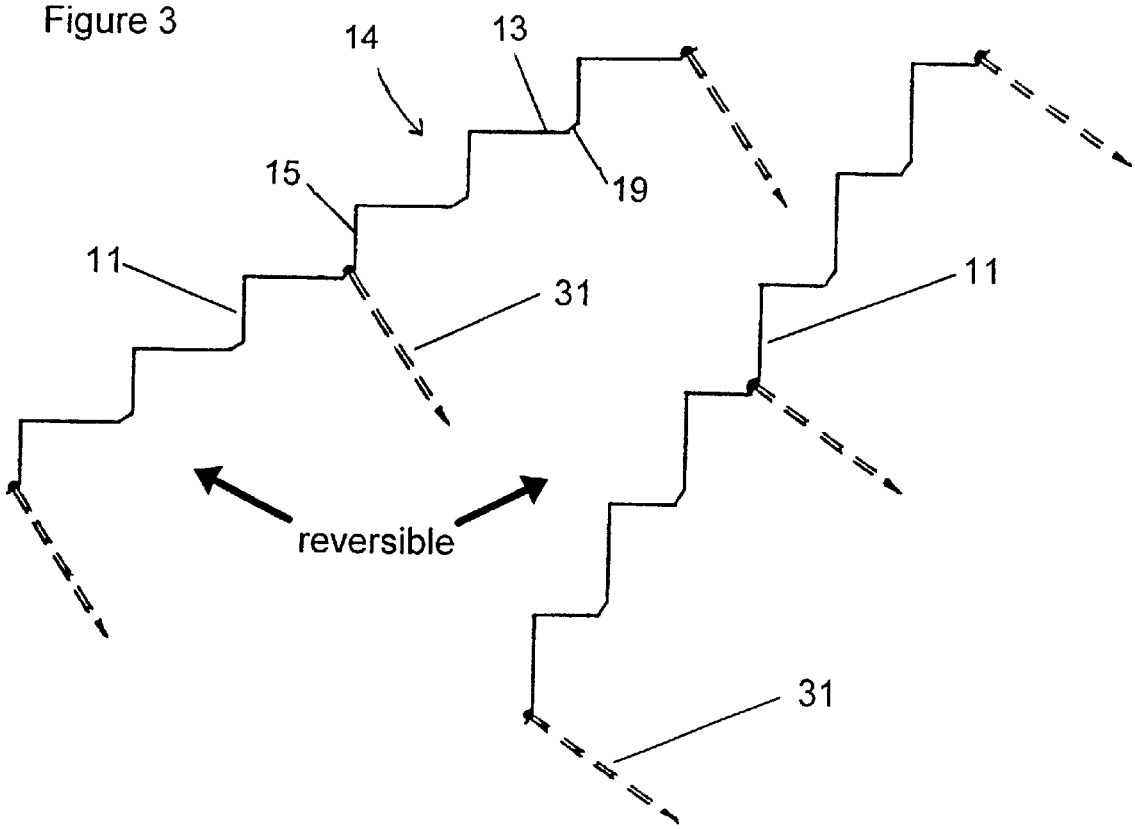

In FIG. 3, two rigid modules of stairway 11 are shown, which can be reversed to accommodate different gradients of site. The riser member 15 and tread member 13 of each step 14 are of unequal dimensions, such that the stairway module 11 can be laid against supporting ground in one of two configurations.

In the first configuration, shown on the left of FIG. 3, the depth of each tread member exceeds the height of the riser member of the same step, so that the stairway module is suitable for use on a slope of low gradient. Alternatively, in the second configuration of the stairway module, shown on the right of FIG. 3, elements of the module which were previously riser members now constitute tread members, and vice versa. In this way, the stairway module can be used on slopes of a steeper gradient. Preferably both the riser member and the tread member of each step incorporate a non-slip surface, so that either element is suitable for use as a tread member, depending on the configuration of the stairway module relative to the sloping surface.

Figure 4:
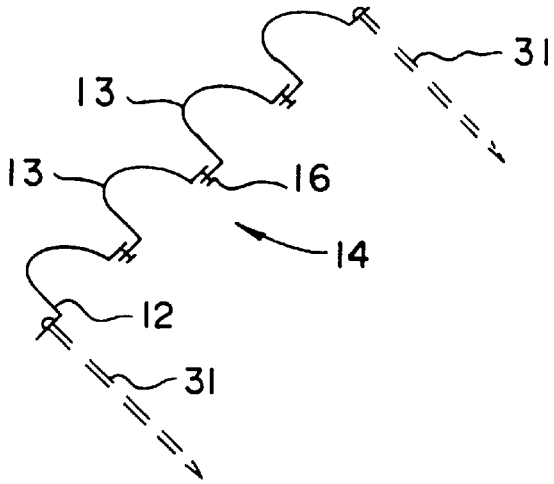
FIGS. 4 to 6 show embodiments of a first aspect of the present invention having curved tread members.

Referring to FIG. 4, there is shown a module of stairway 12 in which the individual stairs 14 are non-integral, and are permanently or releasably linked together to permit limited movement of one stair relative to the others. The stair treads 13 are curved. The links 16 between the stairs 14 comprise bolts, pins, straps, hooks, rings, shackles or other such connectors (not shown in detail). The stair treads 13 incorporate a "non-slip" surface such as a ribbed, patterned, textured or perforated surface or an area of mesh (not shown in detail).

Figure 5:
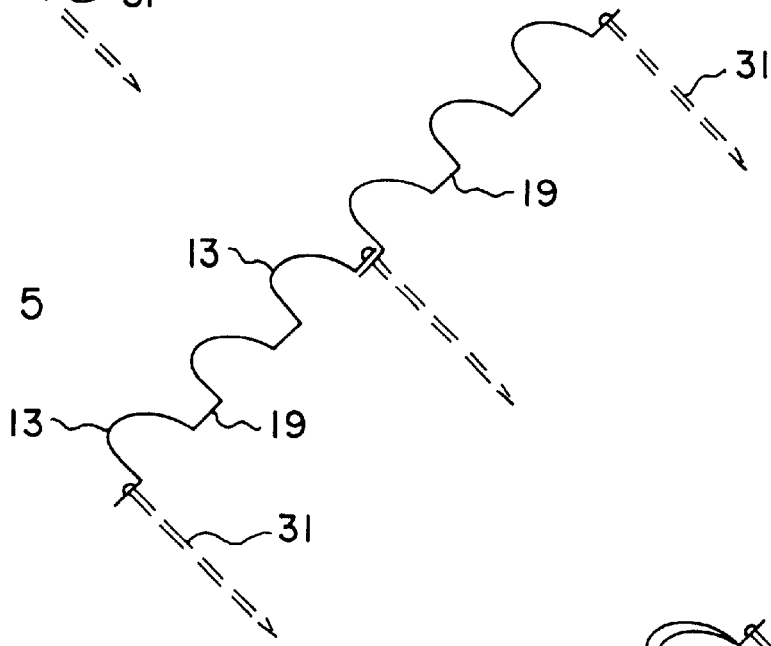

FIG. 5 shows a stairway comprising two rigid modules of stairway with curved treads 13.

Figure 6:
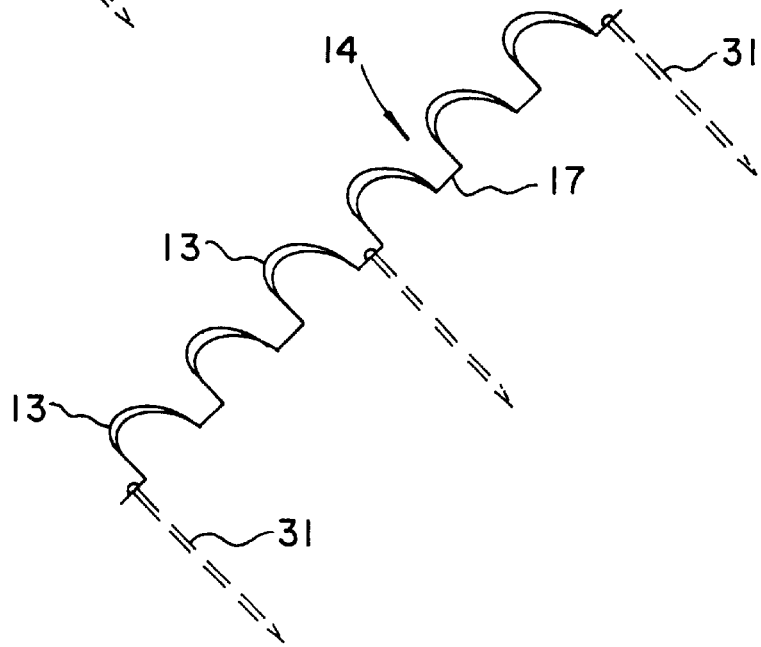

FIG. 6 shows a stairway module with rigid, curved treads 13 which are mounted on a flexible base structure 17 to accommodate variations in the gradient of the site. The flexible structure 17 can, for example, incorporate moulded plastic, fiberglass, rubber, mesh or woven fibre, and can be bent to change the relative positions of each step in the stairway module.

Figure 7:
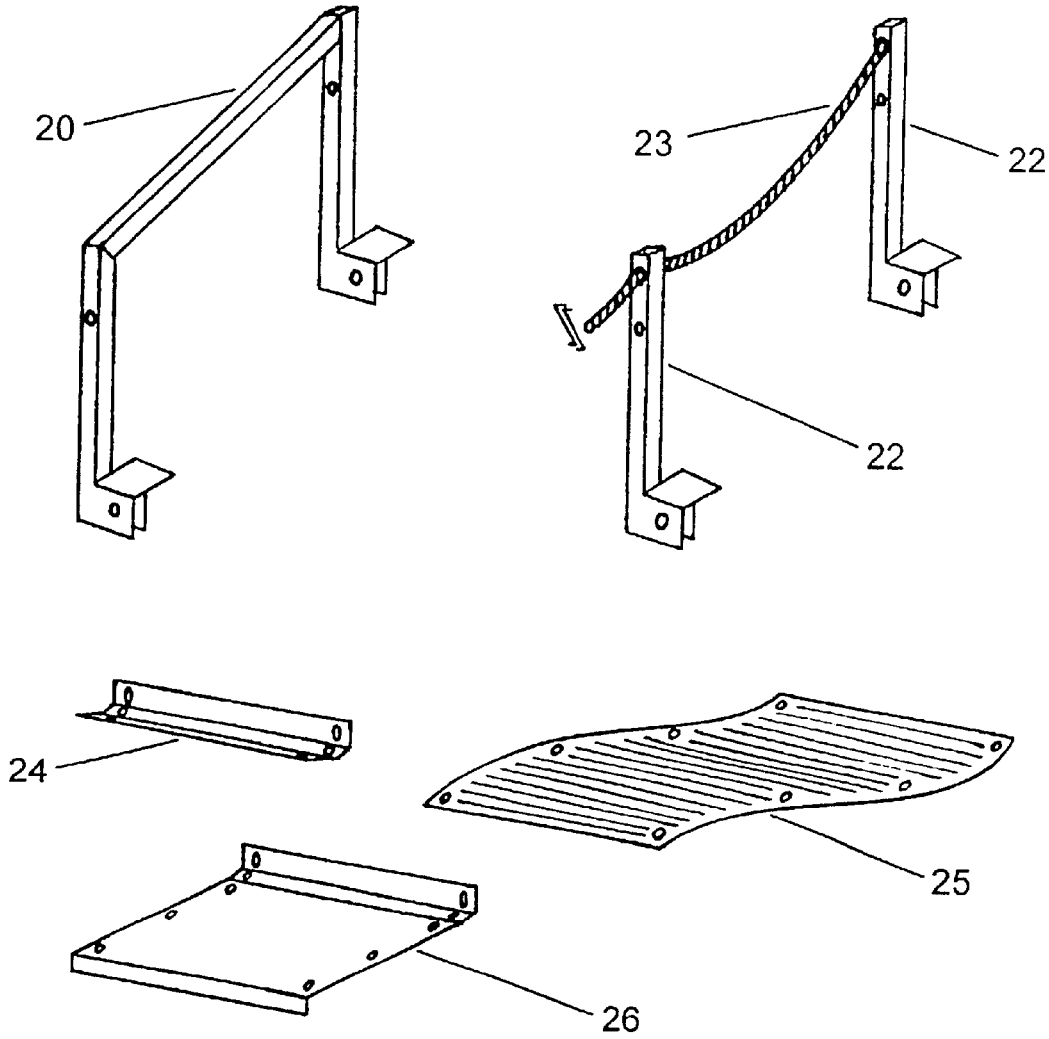
FIG. 7 shows accessories for use in conjunction with modules according to a third aspect of the present invention.

Referring to FIG. 7, examples are shown of accessories for use in conjunction with stairway modules according to the present invention. These include a handrail 20, supports for a handrail or guide-rope 22, a guide-rope 23, a connector plate 24, a module of walkway 25 and a landing plate 26.

Figure 8:
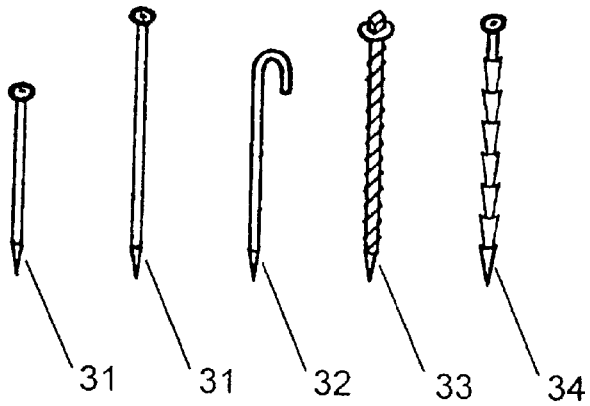
FIG. 8 shows examples of fixing means for use in conjunction with modules according to a first aspect of the present invention.

FIG. 8 shows examples of fixings suitable for use in conjunction with the stairway modules and/or accessories described above. They include pins, pegs or nails 31, hooked fixings 32, bolts, screws, threaded or spiral fixings 33 and barbed, splayed or expanding fixings 34.

Figure 9:
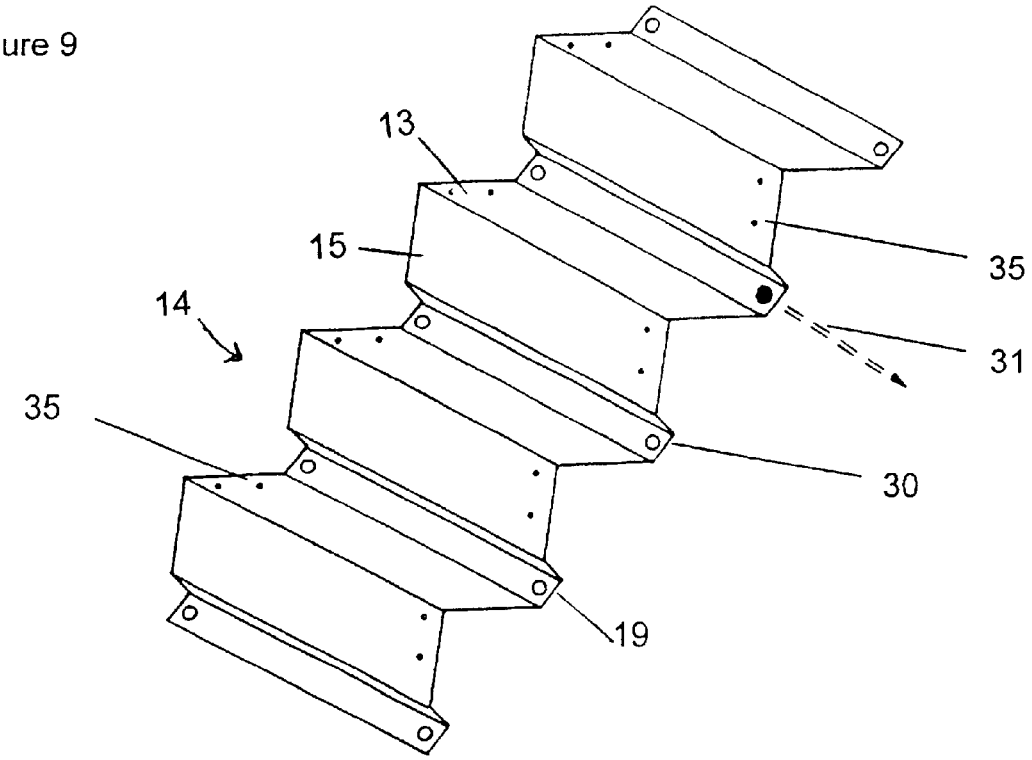
FIG. 9 shows a perspective view of an embodiment of a first aspect of the present invention, with a bridging member separating each step in the module.

Referring to FIG. 9, a module of stairway according to the present invention can be used in either a forward or a reverse configuration, to accommodate different gradients of site (as in FIG. 3). The bridging members 19 between the steps 14 are substantially L-shaped, the angle between the two elements of each bridging member 19 providing that the tread member 13 of each step projects approximately horizontally from the slope on which the stairway module is laid. The stairway module can be used in either configuration, as also shown in FIG. 3, depending on the gradient of the slope.

The stairway module can be produced from a variety of materials including steel tread plate (with or without a galvanized finish), aluminum tread plate, metal, plastic or fibreglass. Housings such as holes or slots 30 are provided for fixings such as pins 31. Housings such as holes or slots 35 are also provided for attaching supports for a handrail or guide-rope.

Figure 10:
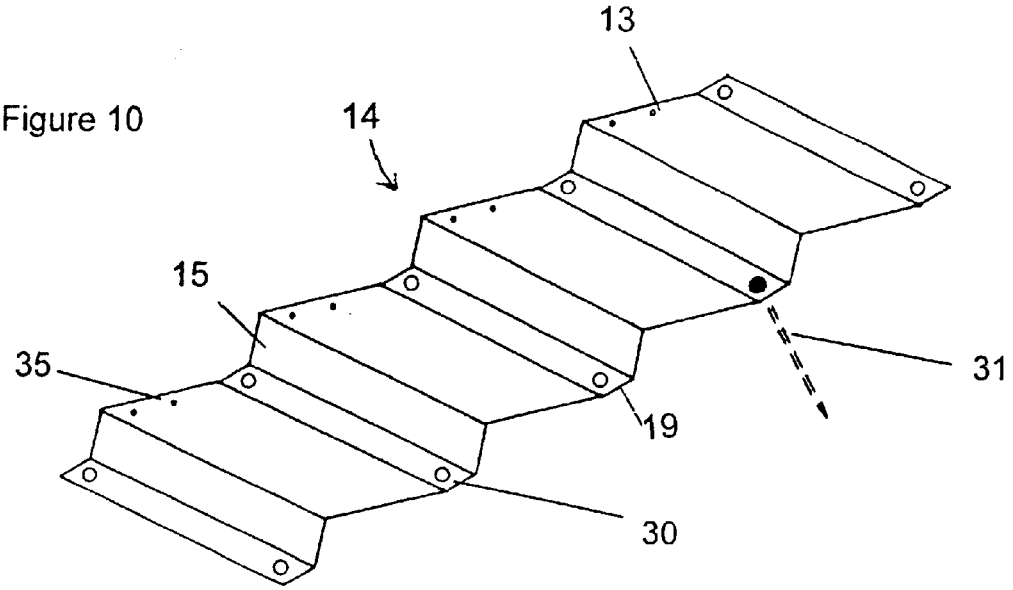
FIG. 10 shows an embodiment of a first aspect of the present invention suitable for use on low gradient slopes.

Referring to FIG. 10, a module of stairway is illustrated for use on sites with shallow gradients. The tread members 13 are of a greater depth than the height of the corresponding riser members 15 in each step 14. In this way, the stairway module in the configuration shown in FIG. 10 progresses to a greater extent in the horizontal (forward) direction than it does in the vertical direction. The module can be produced from materials such as those listed above.

Figure 11:
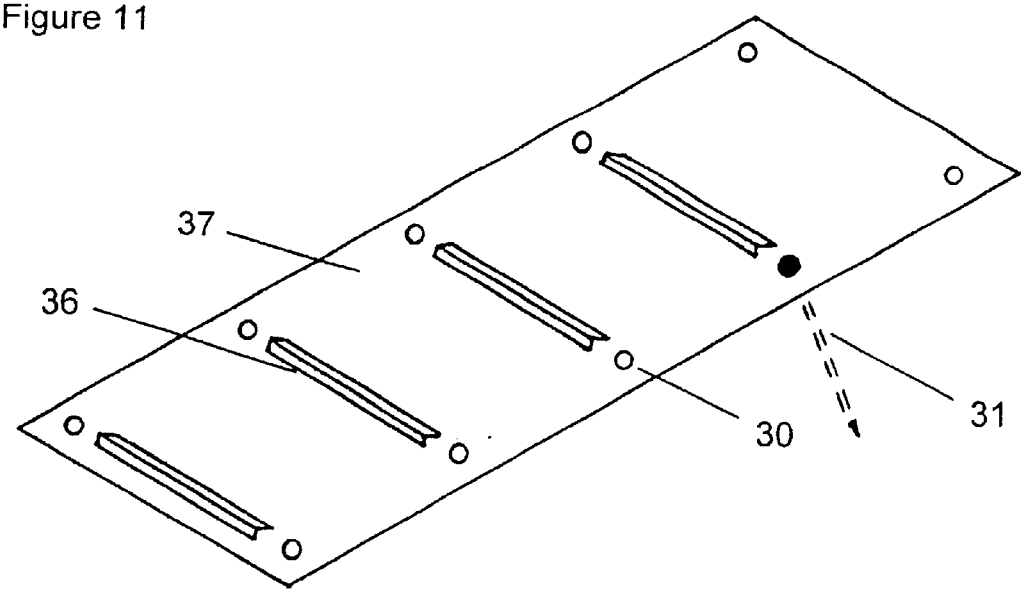
FIG. 11 shows a module of walkway for use in conjunction with a stairway module according to a third aspect of the present invention.

FIG. 11 shows a module of walkway which can be produced from a variety of materials, including those listed above. Lateral bars 36 are attached to a base 37 to produce a "non-slip" surface, and housings such as holes or slots 30 are provided for fixings such as pins 31. The walkway is suitable for use on an area of ground that is substantially horizontal, in conjunction with the stairway modules described herein.

Figure 12:
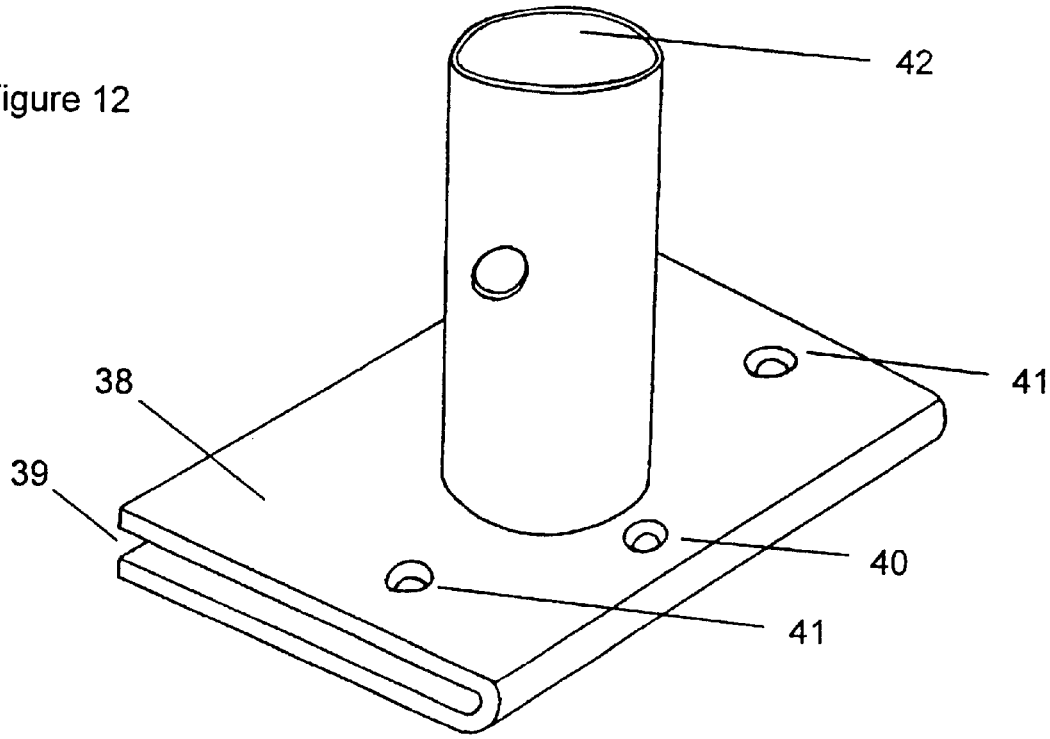
FIG. 12 shows a base piece suitable for supporting a handrail or guide-rope in a stairway provided for by the present invention.

In FIG. 12, part of an assembly for supporting a handrail or guide-rope is shown. A base plate 38 is provided with a recess 39 to fit over the side of a stair tread. The base plate 38 is secured to the stair tread using a quick-release pin or clip or other fixing passed through through-holes 40 in the upper and lower faces of the base plate 38 and in the stair tread. Alternatively, the base plate is secured to the stair tread using bolts or other fixings passed through through-holes 41 in the upper and lower faces of the base plate and in the stair tread. A support for a handrail or guide-rope is provided with a housing 42 attached to the base plate.

A prefabricated stairway module as shown in the above-described drawings may be provided in a kit-of-parts for use in constructing a stairway assembly. The kit-of-parts may include at least two stairway modules as already described, as well as various accessories, fixings, modules of walkway, and connecting plates.

Where more than one stairway module according to the present invention is used to construct a stairway, the modules may be connected to each other by a connecting plate, as illustrated by numeral 24 in FIG. 1 and FIG. 7, or they may be connected by pins or other fixings, driven through through-holes in the ends of the stairway modules. By these methods, a stairway of any length may be constructed, using selected lengths, designs and numbers of stairway modules.

What is claimed is:

1. A method of using a prefabricated stairway module to form a stairway resting on a sloping surface, the module comprising a first step and a second step, each step having a tread member and a riser member, each tread member and riser member having a leading edge and a trailing edge, the first step and the second step being inseparably joined by a bridging member, the bridging member being arranged between and connecting the leading edge of the tread member of the first step and the trailing edge of the riser member of the second step, and being inclined relative to the tread and riser members so as to conform to the sloping surface, the stairway module further including plural fixing means spaced along its ascending length for fixing the module to the sloping surface, at least some of the fixing means being associated with and penetrating the bridging member;

said method comprising the steps of:

placing the module on the sloping surface so that the bridging member conforms with the sloping surface; and driving the fixing means into the sloping surface.

2. The method of using a prefabricated stairway module according to claim 1, wherein the depth of the tread member is different from the height of the riser member of the same step.

3. The method of using a prefabricated stairway module according to claim 1, wherein the tread members and riser members incorporate a non-slip surface, the stairway module being reversibly useable so that the tread member and riser member of a single step in one configuration of the module relative to the sloping surface become the riser member and tread member, respectively, in the reverse configuration of the module.

4. The method of using a prefabricated stairway module according to claim 1, wherein the stairway module further comprises a handrail or guide-rope disposed at an edge thereof.

5. The method of using a prefabricated stairway module according to claim 1 wherein the fixing means comprise pins or stakes.

6. The method of claim 1, wherein said step of driving the fixing means into the sloping surface comprises driving the fixing means through the bridging member.

7. A method of using a plurality of prefabricated stairway modules connected together to form a stairway, each of the plurality of modules comprising a first step and a second step, each step having a tread member and a riser member, each tread member and riser member having a leading edge and a trailing edge, the first step and the second step being inseparably joined by a bridging member, the bridging member being arranged between and connecting the leading edge of the tread member of the first step and the trailing edge of the riser member of the second step, and being inclined relative to the tread and riser members so as to conform to the sloping surface, each of the plurality of stairway modules further including plural fixing means spaced along its ascending length for fixing the module to the sloping surface, at least some of the fixing means being associated with and penetrating the bridging member;

said method comprising the steps of:

placing the modules on the sloping surface so that the bridging members conform with the sloping surface and the modules are in contact with each other;

connecting the plurality of modules to each other to form a continuous stairway; and driving the fixing means into the sloping surface.

8. The method of using a plurality of prefabricated stairway module according to claim 7, wherein at least two of the stairway modules have different sizes of tread members and/or riser members.

9. The method of using a plurality of prefabricated stairway module according to claim 7, wherein at least one of the stairway modules further includes a module of walkway, a landing plate, a handrail, a guide-rope or a connector plate attached thereto.

10. The method of using a plurality of stairway modules according to claim 7, wherein said step of connecting the plurality of modules comprises driving fixing means through adjacent modules.

11. The method of claim 7, wherein said step of driving the fixing means into the sloping surface comprises driving the fixing means through the bridging members.

12. A prefabricated stairway module for resting on a sloping surface, said stairway module comprising:

at least first, second and third steps, each step having a tread member and a riser member, each tread member and riser member having a leading edge and a trailing edge;

said first step and said second step being inseparably joined by a first bridging member arranged between and connecting said leading edge of said tread member of said first step and said trailing edge of said riser member of said second step;

said second step and said third steps being inseparably joined by a second bridging member, arranged between and connecting said leading edge of said tread member of said second step and said trailing edge of said riser member of said third step;

said first and said second bridging members being inclined relative to said tread and said riser members, with said first and said second bridging members being on the same plane; and plural fixing means spaced along an ascending length of said module for fixing said module to the sloping surface, at least some of said fixing means being associated with and penetrating at least one of said bridging members.

* * * * *